United States Patent [19]

Suda et al.

[11] 3,938,435

[45] Feb. 17, 1976

[54] AUTOMATIC MAIL PROCESSING APPARATUS

[75] Inventors: Kazuyoshi Suda; Tomoyuki Isono; Teruo Yashima, all of Tokyo, Japan

[73] Assignee: Nippon Electric Co., Ltd., Tokyo, Japan

[22] Filed: Jan. 17, 1974

[21] Appl. No.: 434,335

[30] Foreign Application Priority Data

Jan. 19, 1973 Japan ..... 48-9074

[52] U.S. Cl. ..... 101/2; 101/234; 198/DIG. 16; 198/271; 209/DIG. 1; 209/74 M; 271/64; 355/23

[51] Int. Cl.[2] ..... B41F 21/00; B41F 10/00

[58] Field of Search..... 198/262, DIG. 16, 268–272; 101/91, 233–235, 2; 355/23, 26; 271/9, 64, 65; 209/DIG. 1, 72, , 74 M

[56] References Cited

UNITED STATES PATENTS

| | | | |
|---|---|---|---|
| 2,894,626 | 7/1959 | Mulders et al. | 209/DIG. 1 |
| 2,928,337 | 3/1960 | Pollak, Jr. | 101/91 |
| 2,936,886 | 5/1960 | Harmon | 209/111 |
| 2,984,349 | 5/1961 | Mathis | 209/DIG. 1 |
| 2,988,984 | 6/1961 | Eckert, Jr. et al. | 101/2 |
| 3,083,012 | 3/1963 | Poland | 271/64 |
| 3,141,540 | 7/1964 | Burkhardt | 209/72 |
| 3,227,444 | 1/1966 | Egan | 355/23 |
| 3,641,931 | 2/1972 | Hickox et al. | 271/64 |
| 3,656,616 | 4/1972 | Wallington | 209/74 M |
| 3,724,657 | 4/1973 | Katagiri | 271/64 |

FOREIGN PATENTS OR APPLICATIONS

| | | | |
|---|---|---|---|
| 1,124,099 | 8/1968 | United Kingdom | 209/DIG. 1 |
| 1,231,628 | 12/1966 | Germany | 209/DIG. 1 |
| 1,280,605 | 10/1968 | Germany | 209/DIG. 1 |
| 1,388,936 | 1/1965 | France | 209/DIG. 1 |

*Primary Examiner*—Edgar S. Burr
*Assistant Examiner*—William Pieprz
*Attorney, Agent, or Firm*—Sughrue, Rothwell, Mion, Zinn and Macpeak

[57] ABSTRACT

In an automatic mail processing apparatus, the mail is fed one by one by a feeding mechanism to a transport path having a stamp detecting station and a canceling station. At the former station, each piece of the mail is scanned by a pair of detectors which determine the presence or absence of a stamp at the lower end portion of both surfaces of the piece of mail. In the absence of a stamp at the particular portion, the piece of mail is switched to another transport path where it is reversed for subsequent rescanning. When the reversed piece of the mail is fed back to the transport path, the operation of the feeding mechanism is temporarily stopped to prevent the reversed piece of the mail from meeting with subsequent pieces of the mail to be fed by the mechanism.

7 Claims, 3 Drawing Figures

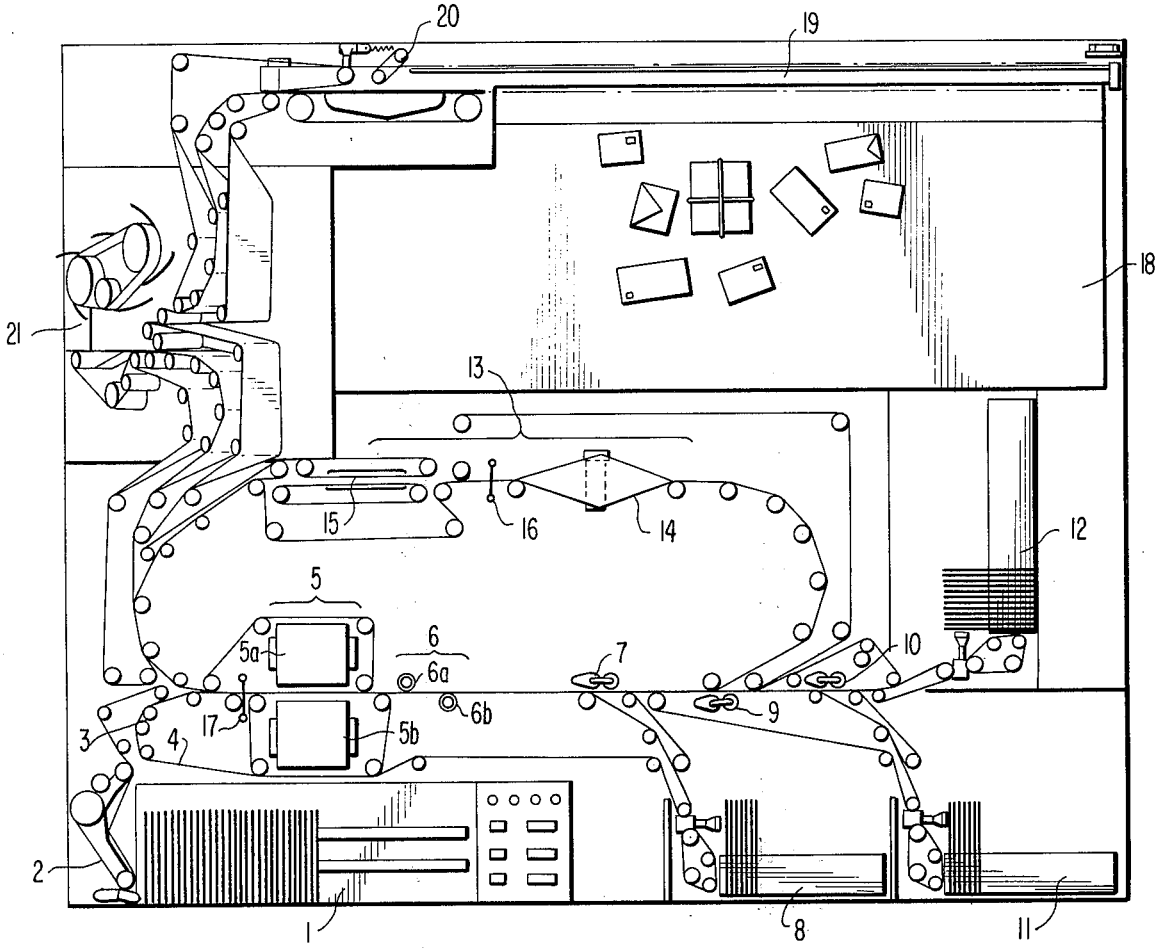
FIG. 1
FIG. 2
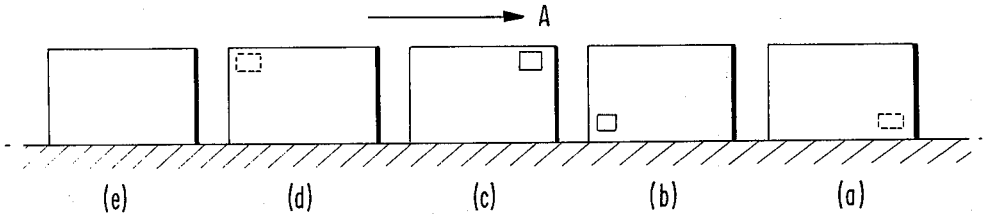

AUTOMATIC MAIL PROCESSING APPARATUS

BACKGROUND OF THE INVENTION

This invention relates to an automatic mail processing apparatus, and more particularly, to an automatic mail processing apparatus adapted to a post office of a medium or small scale.

A conventional automatic mail processing apparatus is designed, as clearly stated in an article titled "AUTOMATIC MAIL FACING AND CANCELLING APPARATUS" published in the Technical Journal of Nippon Electric Company, Limited, No. 94, Aug. 1969, pp 24 – 29, and in another article titled "AUTOMATIC LETTER FACING" compiled in the proceedings of the CONFERENCE ON BRITISH POSTAL ENGINEERING published by The Institute of Mechanical Engineers, 1970, to be adapted for installation in a large-scale post office wherein forty or fifty thousand or more pieces of mail such as envelopes and postcards are processed a day. For this reason, these conventional apparatuses necessarily have a complicated mechanism and control function therefor, and require a large space for installation. This makes the apparatus as a whole more expensive and its maintenance work more complicated and costly.

On the other hand, it has become necessary to mechanize the mail processing in a medium- or a small-scale post office with a processing capacity of less than thirty thousand pieces of mail. Such post office does not usually have sufficient space for installation of a large scale apparatus such as the above-mentioned conventional mail handling apparatus requiring large space for installation. Furthermore, it is not economical for such a post office to use a mail handling apparatus with a high processing capacity, e.g., a high processing speed as in the conventional apparatus. A reduced cost of manufacture is more important for such use even if the processing capacity is considerably sacrificed.

It is, therefore, an object of this invention to provide an improved automatic mail processing apparatus with a simplified mechanism adapted to a medium or a small scale post office.

SUMMARY OF THE INVENTION

According to this invention, there is provided an improved automatic mail processing apparatus in which mail fed from a feeder to a postage stamp detector to detect postage stamps thereon for subsequent cancellation of the detected postage stamps by a canceler. Those pieces of mail on which postage stamps are not detected are reversed and then supplied again to the postage stamp detector.

The features and advantages of this invention will be better understood from the following detailed description of a preferred embodiment of this invention taken in conjunction with the accompanying drawings, wherein:

BRIEF DESCRIPTION OF THE DRAWINGS

FIG. 1 is a plan view of an embodiment of this invention;

FIG. 2 shows various positions assumed by the mail having postage stamps thereon.

DETAILED DESCRIPTION OF THE PREFERRED EMBODIMENTS

Figure 3:
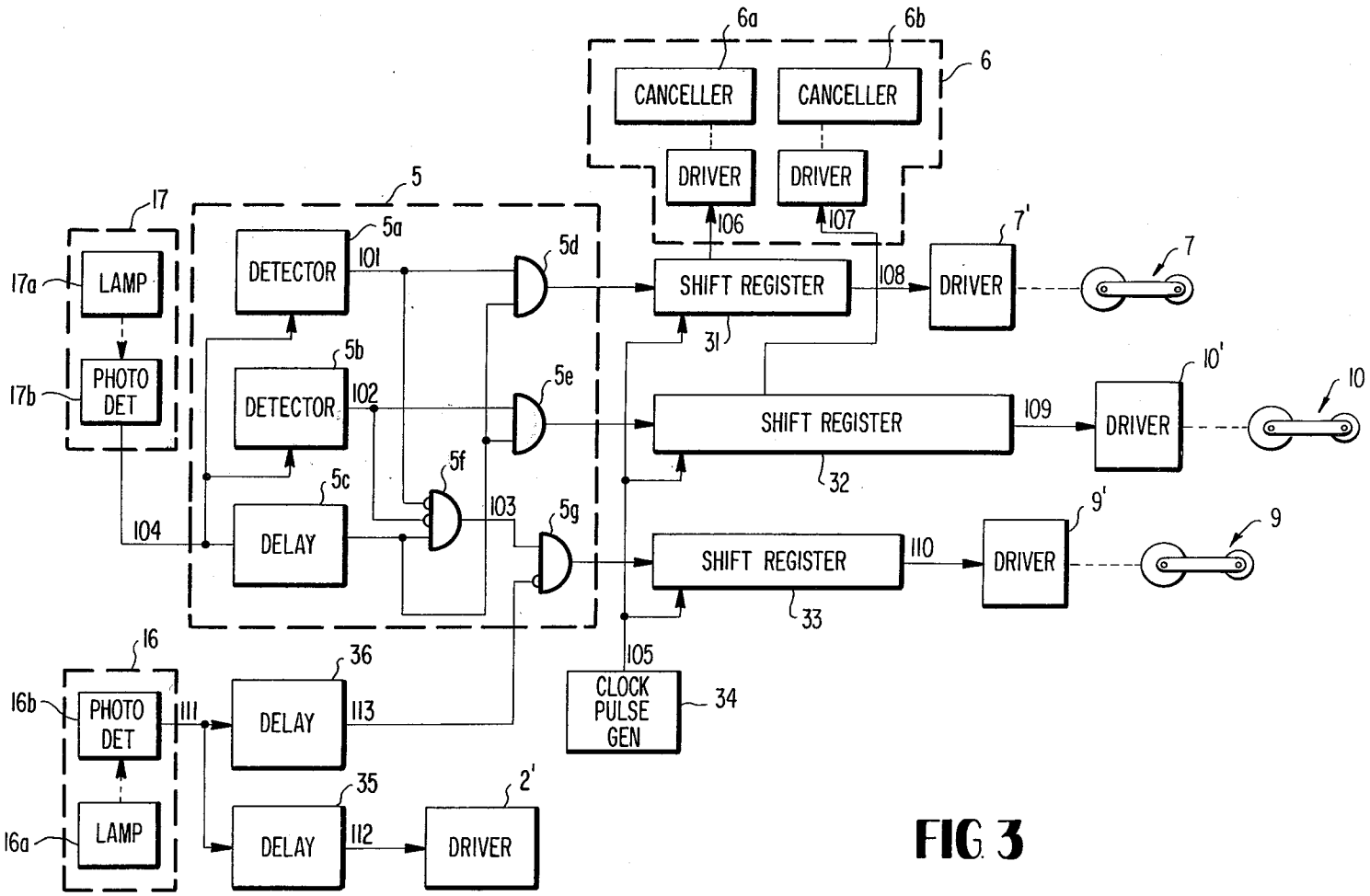
FIG. 3 is a block diagram of an electrical control unit of the embodiment shown in FIG. 1.

Referring to FIG. 1, an embodiment of this invention comprises a feeder 1 designed to feed the mail one by one. Those pieces of mail which are of mechanically processable size are fed from the feeder 1 by a feeding belt 2 one by one to a transport path 3 provided by a pair of conveyor endless belts 4. The mail held in a sandwich fashion between the conveyor belts 4 supplied at a constant feeding speed to a postage stamp detecting station 5.

The mail fed from the feeder 1 is classified into five positions (a), (b), (c), (d) and (e) according to the position of postage stamps thereon, as shown in FIGS. 2(a) through 2(e). In the position (a), the postage stamp is on the lower leading portion of the back surface of the mail with respect to the transporting direction shown by the arrow A, while in the position (b), the stamp lies on the lower trailing portion of the front surface. Similarly, in the position (c), it is on the upper leading portion of the front surface, while on the upper trailing portion of the back surface in the position (d). FIG. 2(e) shows the case where there is no stamp on the mail. The stamp detecting station 5 comprises a back-surface lower leading-portion stamp detector 5*a* for detecting the stamp on the mail as in the position (a) by scanning a lower portion on the back surface of the mail, and a front-surface lower-trailing portion stamp detector 5*b* for detecting the stamp as in the position (b) by scanning a lower portion on the front surface. These stamp detectors are provided on opposite sides, respectively, of the transport path 3. One example of these detectors 5*a* and 5*b* is described in the U.S. Pat. No. 3,745,527, assigned to the assignee of this application and entitled "ELECTROOPTICAL DEVICE FOR DISCRIMINATING A PREDETERMINED PATTERN FROM OTHERS BY DETECTING PRESELECTED COLOR CHANGES IDENTIFYING THE PATTERN".

The postage stamps on the mail in the positions (a) and (b) are detected by the detectors 5*a* and 5*b*, respectively. Those pieces of mail, passing through the detecting station 5, are fed to a canceling station 6 having cancelers 6*a* and 6*b* which are provided downstream of the stamp detectors and adapted for the mail matters in the positions (a) and (b), respectively. The postage stamps on the pieces of mail in the positions (a) and (b) are canceled by the cancelers 6*a* and 6*b*, respectively, and the cancelers 6*a* and 6*b* are not actuated unless the postage stamp is detected in the detecting station 5. Thus, when the pieces of mail in the positions (c), (d) and (e) are passed through station 5, cancellers 6*a* and 6*b* will not be actuated.

The mail passed through the canceling station 6 is fed to a branching or switching station having branching devices 7, 9 and 10. One example of these branching devices 7, 9 and 10 is described in the U.S. Pat. No. 3,724,657, assigned to the same assignee of this application and entitled "SWITCHING DEVICE FOR DELIVERING SHEET-LIKE ARTICLES".

The piece of mail in the position (a) is, after being canceled by the canceler 6*a*, switched from its transport path to a first branching path by the branching device 7 and fed to a first stacker 8. Similarly, the piece of mail in the position (b), canceled by the canceler 6*b*, is switched from its transport path to a second branching path by the branching device 10 and fed to a second stacker 11. The pieces of mail in the remaining positions (c), (d) and (e) are switched to a return path 13 by the branching device 9. The canceling at the canceling station 6 and the switching from the transport path by the branching device 7, 9 or 10 are timed under the control of the unit shown in FIG. 3 in response to a detected signal from a light coupler 17 and a stamp signal from the detecting station 5 as will be described in detail hereinafter. The light coupler 17 is of the conventional type comprising a light source and a photodetector and is provided in the transport path 3 upstream of the stamp detectors 5*a* and 5*b*.

The mail switched to the return path 13 by the branching device 9 is passed through a reversing station 14 in the return path 13 for flipping over, or turning over a piece of mail. Therefore, the pieces of mail in the positions (c) and (d) are changed to the positions (a) and (b), respectively, by being passed through the reversing station 14. The reversed pieces of mail are fed to an aligning station 15 in the return path 13 to align the lower sides thereof with each other, and fed again to the transport path 3 and the detecting station 5 for the re-scanning of the lower portion of the reversed pieces of mail. The piece of mail aligning means are well known, see for example, U.S. Pat. No. 3,203,534, from the return path 13 is now in the position (a), (b) or (e).

When the mail is fed from the return path 13 to the transport path 3, the rotation of the feeding belt 2 of the feeder 1 is temporarily stopped in response to a detected signal from a light coupler 16 so as not to meet with the pieces of mail to be fed from the feeder 1. The light coupler 16 is also of the conventional type similar to the light coupler 17. The pieces of mail which are in the positions (a) and (b) and fed to the transport path 3 are similarly processed, that is, subjected to the postage stamp detection by the detectors 5*a* and 5*b*, cancelled by the cancelers 6*a* and 6*b*, and fed to the stackers 8 and 11, respectively. The piece of mail in the position (e), after being fed from the return path 13 and re-scanned, is fed to a third stacker 12 without actuating any of the switching devices 7, 9 and 10 in response to the detected signal from the light bar 16 and the signal from the detecting station 5.

Referring to FIG. 3, the electrical control unit of the embodiment shown in FIG. 1 includes the light coupler 17 composed of a lamp 17*a* and a photodetector 17*b*, and the detecting station 5 comprising the detectors 5*a* and 5*b*, a delay circuit 5*c*, AND circuits 5*d* and 5*e* and INHIBIT circuits 5*f* and 5*g*. When a piece of mail traverses the light from the lamp 17*a*, a signal 104 is obtained at the photodetector 17*b*. Then, the mail is fed to the detecting station 5 which produces detected signals 101, 102 and 103 representing the positions (a) and (b) and the absence of a stamp on the lower side, respectively. In other words, when the pieces of mail in the positions (a) and (b) are fed to the detecting station 5, the signals 101 and 102 are obtained from the detectors 5*a* and 5*b*, respectively, which are then reset by the signal 104 representing the immediately following piece of mail coming into the light coupler 17. The signals 101 and 102 are also applied to inhibit terminals of the INHIBIT circuit 5*f* so as to inhibit the signal 104 delayed by the delay circuit 5*c*. The delay time of the delay circuit 5*c* is defined to equal the time period in which a piece of mail is transported from the light coupler 17 to the detecting station 5. Therefore, the signal 103 is obtained from the INHIBIT circuit 5*f* when the piece of mail has no stamp on the lower portion, i.e., is in the position (c), (d) or (e).

The signals 101, 102 and 103 are applied through the AND circuits 5*d* and 5*e* and the INHIBIT circuit 5*g* to shift registors 31, 32 and 33, respectively, to which a clock pulse 105 is applied from a clock pulse generator 34. Because the clock pulse 105 is synchronized with the transportation of the conveyor belt 4, the shifting of the signals 101, 102 and 103 in the shift registors 31, 32 and 33 is also synchronized with the transportation of the conveyor belt or the mail. After the lapse of time during which the mail is transported from the detectors 5*a* and 5*b* to the cancelers 6*a* and 6*b*, canceler driving signals 106 and 107 are obtained from the shift registors 31 and 32 and applied to canceler drivers 6*c* and 6*d* to actuate the cancelers 6*a* and 6*b*, respectively. Furthermore, when the mail transported from the detecting station 5 arrives at the branching devices 7, 10 and 9 after application of certain numbers of the clock pulses to the shift registors 31, 32 and 33, driving signals 108, 109 and 110 for the branching devices 7, 10 and 9 are obtained from the shift registors 31, 32 and 33 and applied to drivers 7′, 10′ and 9′, whereby the mail is transported to the stackers 8 and 11 and to the return path 13, respectively.

The mail travelling through the return path 13 traverses the light from a lamp 16*a*, whereby a signal 111 is produced by a photodetector 16*b*. The signal 111 is applied to a delay circuit 35 and delayed by a length of time sufficient to prevent the piece of mail from the return path 13 from meeting with that to be fed from the feeder 1. The delayed signal 112 is applied to a belt driving means 2′ to temporarily stop the movement of the conveyor belt 2 in the feeder 1 by activating, for example, a clutch not shown.

The signal 111 is also applied to a delay circuit 36 and delayed by a time period in which the mail is transported from the light coupler 16 to the detecting station 5. The delayed signal 113 is applied to an inhibit terminal of the INHIBIT circuit 5*g* so as to inhibit the signal 103 in case where no stamp on the mail from the return path 13 is detected. Therefore, in this case, the mail is fed to the stacker 12 without actuating any of the switching devices 7, 9 and 10.

Referring again to FIG. 1, the embodiment of this invention comprises a culling table 18 on which the mechanically processable mail is manually culled from those collected from mail-boxes. The mechanically processable mail is put into a U-shaped conveyor belt 19 and fed through an averaging means 20 for causing the mail to flow at a substantially constant rate to a stacker-feeder 21, as shown in the U.S. Pat. No. 3,604,702, assigned to the same assignee as this application and entitled "AUTOMATIC STACKER-FEEDER FOR A MAIL-HANDLING SYSTEM", in which the mail is temporarily stacked and then fed one by one.

The apparatus can be caused to scan at the detecting section 5 those pieces of mail from the return path 13 first, those from the stacker-feeder 21 next and then those from the feeder 1, by installing a light coupler (not shown) for detecting the mail from the stacker-feeder 21. In this case, even if only a single piece of mail is detected by the light bar 16 in the return path 13, the feeding by the stacker-feeder 21 and the feeder 1 is stopped to allow the mail to be fed from the return path 13 to the detecting station 5 so that, the time needed for processing is inevitably increased to eventually lower the processing speed. To solve this problem, a stacker-feeder means identical to the stacker-feeder 21 may be installed in the return path 13, by which the mail is stacked until a predetermined amount of mail is stacked, and then fed one by one, while inhibiting the feeding from the feeders 1 and 21.

It should be noted here that the technical scope of the invention is not limited to the above exemplary embodiment. For example, the mail may be stacked in a larger number of groups into which the mail is classified depending on the kind of the mail (ordinary mail and express mail) or the kind of postage stamps. Such modification is readily achieved by installing the branching devices and the stackers in accordance with the number of groups. Many other variations will occur to those skilled in the art within the scope of the invention.

What is claimed is:

1. A mail processing apparatus comprising:

means defining a mail transport path along which said mail is transported;

means for feeding said mail piece-by-piece to said mail transport path;

a pair of postage stamp detectors provided on both sides of said mail transport path;

a first light coupler provided in said mail transport path upstream of said postage stamp detectors and adapted to sense each piece of said mail passing thereby;

a pair of cancelers provided on both sides of said mail transport path downstream of said postage stamp detectors, each of said cancelers being adapted to be actuated at a predetermined time after each piece of said mail is sensed by said first light coupler;

means defining a return path;

means responsive to a failure of said postage stamp detectors to detect a postage stamp on each piece of said mail for switching said piece of mail from said transport path to said return path at another predetermined time after said piece of mail is sensed by said first light coupler;

means provided in said return path for reversing each piece of said mail;

a second light coupler provided in said return path to sense each reversed piece of said mail passing thereby;

means for aligning the lower sides of the reversed pieces of said mail with each other;

means for switching said reversed mail in said return path back to said mail transport path;

means for controlling the operation of said feeding means in response to each piece of said mail being sensed by said second light coupler; and means responsive to a failure of said postage stamp detectors to detect a postage stamp on the reversed piece of said mail for removing said piece of mail from said mail transport path.

2. The apparatus as set forth in claim 1, in which said first and second light couplers each comprise a light source and a photodetector between which each piece of said mail is passed.

3. The apparatus as set forth in claim 1, in which said first light coupler produces a reset signal for resetting said pair of postage stamp detectors in response to each piece of said mail being sensed thereby; a first delay circuit is provided for delaying the reset signal for a time period equal to that required to transport said mail from said first light coupler to said postage stamp detectors; a pair of AND circuits are provided having their inputs connected to the output of their associated postage stamp detectors and of said first delay circuit.

4. The apparatus as set forth in claim 3, in which a pair of shift registers are provided having their inputs connected to the output of their associated AND circuits; a clock pulse generator is provided for supplying clock pulses to said pair of shift registers in synchronism with the transportation of said mail along said mail transport path; said pair of cancelers are adapted to be actuated in response to signals from their associated shift registers.

5. The apparatus as set forth in claim 4, in which a first INHIBIT circuit is provided having two inhibit terminals connected to the outputs of said postage stamp detectors and one input connected to the output of said first delay circuit; a third shift register is provided having its input connected to the output of said first INHIBIT circuit and its output connected to said first-named switching means, said third shift register being also clocked by said clock pulse generator.

6. The apparatus as set forth in claim 5, in which a second delay circuit is provided having its input connected to said second light coupler; a second INHIBIT circuit is provided for inhibiting the passage of the first INHIBIT circuit output to said third shift register in response to the output of said second delay circuit, the delay time of said second delay circuit being set to equal the time required to transport said mail from said second light coupler back to said postage stamp detectors.

7. The apparatus as set forth in claim 1, in which said controlling means comprises a third delay circuit having its input connected to said second light coupler and its output to said feeding means.

* * * * *

UNITED STATES PATENT OFFICE

CERTIFICATE OF CORRECTION

PATENT NO. : 3,938,435

DATED : February 17, 1976

INVENTOR(S) : Kazuyoshi Suda, Tomoyuki Isono, Teruo Yashima

It is certified that error appears in the above-identified patent and that said Letters Patent are hereby corrected as shown below:

Column 1, line 34 - after "requiring" insert -- a --

Column 2, line 10 - after "belts 4" insert -- is --

Column 3, lines 24-27 - delete "The piece of mail... (a), (b) or (e)." Insert --Aligning means are well known, see for example, U.S. Patent No. 3,203,534. The piece of mail from the return path 13 is now in the position (a), (b) or (e).--

Column 4, line 67 - delete "5 so that," and insert -- 5, so that --

Signed and Sealed this

*fifteenth* Day of *June 1976*

[SEAL]

*Attest:*

RUTH C. MASON
*Attesting Officer*

C. MARSHALL DANN
*Commissioner of Patents and Trademarks*